US010777135B2

(12) United States Patent
Nien et al.

(10) Patent No.: US 10,777,135 B2
(45) Date of Patent: Sep. 15, 2020

(54) CONTROLLING CIRCUIT FOR COMPENSATING A DISPLAY DEVICE AND COMPENSATION METHOD FOR PIXEL AGING

(71) Applicant: Novatek Microelectronics Corp., Hsinchu (TW)

(72) Inventors: Chen-Ming Nien, Changhua County (TW); Yu-Yi Chien, New Taipei (TW)

(73) Assignee: Novatek Microelectronics Corp., Hsinchu (TW)

( * ) Notice: Subject to any disclaimer, the term of this patent is extended or adjusted under 35 U.S.C. 154(b) by 2 days.

(21) Appl. No.: 16/209,997

(22) Filed: Dec. 5, 2018

(65) Prior Publication Data

US 2020/0184887 A1 Jun. 11, 2020

(51) Int. Cl.
*G09G 3/3233* (2016.01)

(52) U.S. Cl.
CPC ..... *G09G 3/3233* (2013.01); *G09G 2300/043* (2013.01); *G09G 2320/0285* (2013.01); *G09G 2320/043* (2013.01)

(58) Field of Classification Search
CPC ..... G09G 2320/043–048; G09G 3/3208
See application file for complete search history.

(56) References Cited

U.S. PATENT DOCUMENTS

| | | | | |
|---|---|---|---|---|
| 6,897,855 | B1 * | 5/2005 | Matthies | H01L 27/156 345/204 |
| 7,088,318 | B2 | 8/2006 | Malmberg | |
| 2011/0242074 | A1 * | 10/2011 | Bert | G09G 3/3208 345/207 |
| 2016/0133175 | A1 * | 5/2016 | Lee | G09G 3/3208 345/694 |
| 2016/0335965 | A1 * | 11/2016 | Huang | G09G 3/3208 |
| 2018/0068606 | A1 * | 3/2018 | Dighde | G09G 3/2003 |
| 2018/0144674 | A1 * | 5/2018 | Gupta | G09G 3/3233 |
| 2018/0182278 | A1 * | 6/2018 | Kim | G09G 3/3275 |
| 2019/0074341 | A1 * | 3/2019 | Cai | G09G 3/3266 |
| 2019/0080666 | A1 * | 3/2019 | Chappalli | G09G 3/22 |

OTHER PUBLICATIONS

Fu et al., "A Fast TFT Threshold Voltage Sensing Method Based on Iterative Feedback", SID Digest, vol. 48, Issue1, 2017, pp. 204-206.

* cited by examiner

*Primary Examiner* — Laurence J Lee
(74) *Attorney, Agent, or Firm* — JCIPRNET

(57) ABSTRACT

A compensation method for pixel aging applicable to controlling circuit of a display device having a display panel is provided. The method includes: receiving a display content; predicting an aging of each of a plurality of pixels of the display panel resulting from the display content in order to obtain an aging prediction; generating a display data to compensate the display panel based on the aging prediction; and outputting the display content. Besides, a controlling circuit using the method for compensating a display device is also provided.

18 Claims, 10 Drawing Sheets

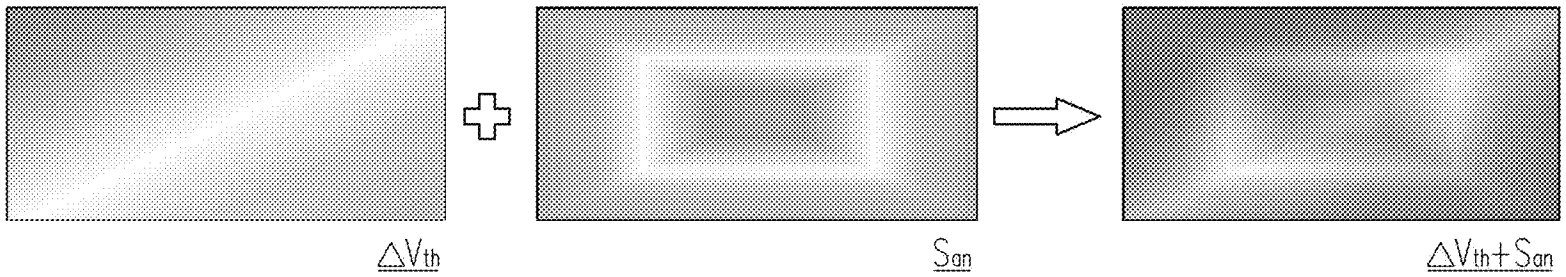

| Take a pixel for example | | Time (Frame) | | | | | | | | |
|---|---|---|---|---|---|---|---|---|---|---|
| | | non-display time | frame 1 | frame 2 | frame 3 | frame 4 | ... | frame n-2 | frame n-1 | frame n |
| Vth compensation table sensed at panel non-display time | $\Delta V_{th}$ | 42 | 42 | 42 | 42 | 42 | .. | 42 | 42 | 42 |
| display input data | $f_n$ | 0 | 25 | 87 | 0 | 40 | .. | 200 | 120 | 35 |
| aging model convert $f_n$ to aging data (assume model is [$f_n$/10] ) | $a_n$ | 0 | 3 | 9 | 0 | 4 | .. | 20 | 12 | 4 |
| accumulated aging data stored in RAM | $Sa_{n-1}$ | 0 | 0 | 3 | 12 | 12 | .. | 489 | 509 | 521 |
| each frame $S_{n-1} + a_n = S_n$ | $Sa_n$ | 0 | 3 | 12 | 12 | 16 | .. | 509 | 521 | 525 |
| final display compensation value at frame n | $\Delta V_{th}+Sa_n$ | 42 | 45 | 54 | 54 | 58 | ... | 551 | 563 | 567 |

FIG. 5

CONTROLLING CIRCUIT FOR COMPENSATING A DISPLAY DEVICE AND COMPENSATION METHOD FOR PIXEL AGING

TECHNICAL FIELD

The disclosure relates to a display method, and in particular, to a compensation method for pixel aging and a controlling circuit for compensating a display device.

BACKGROUND

With the rapid advance and continual progress in technology, the organic light emitting diode (OLED) technology has been provided and widely used in various applications such as TV, computer monitor, notebook computer, mobile phone or PDA. In general, the OLED display includes many OLED pixel circuits arranged in the form of a matrix, and each OLED pixel circuit includes an OLED element and a corresponding driving circuit. However, pixels of the conventional OLED device are controlled by thin-film transistors (TFT). Consequently, the pixels of the conventional OLED device inherit the disadvantages of the TFTs and would be aged along with using time.

SUMMARY

An aspect of the disclosure provides a compensation method for pixel aging. The compensation method is applicable to a controlling circuit of a display device having a display panel and comprises: receiving a display content by the controlling circuit; predicting by the controlling circuit an aging of each of a plurality of pixels of the display panel resulting from the display content in order to obtain an aging prediction; generating a display data by the controlling circuit to compensate the display panel according to the aging prediction; and outputting the display data by the controlling circuit.

Another aspect of the disclosure provides a controlling circuit for compensating a display device. The controlling circuit includes a receiving circuit, a calculation circuit and an output circuit. The receiving circuit is configured to receive a display content. The calculation circuit is coupled to the receiving circuit and configured to predict an aging of each of a plurality of pixels of a display panel of the display device resulting from the display content in order to obtain an aging prediction, and generate a display data to compensate the display panel according to the aging prediction. The output circuit is coupled to the calculation circuit and configured to output the display data.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

FIG. 5 illustrates a schematic diagram of compensating the display content by using the predicted aging resulting from the display content and the compensation values stored in the storage according to an embodiment of the disclosure.

DESCRIPTION OF THE EMBODIMENTS

Figure 1A:
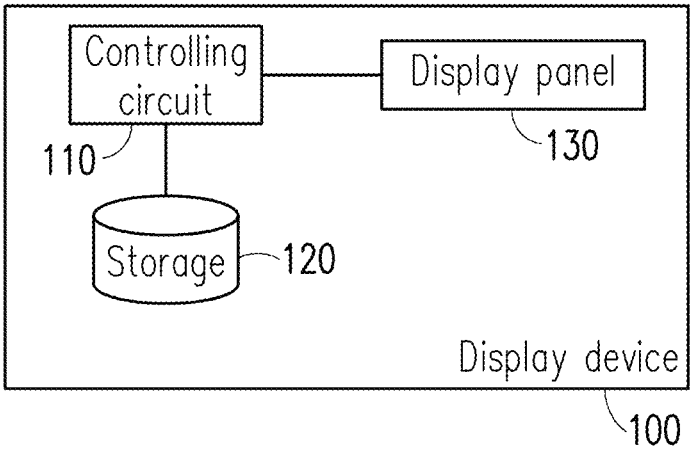
FIG. 1A illustrates a block diagram of a display device according to an embodiment of the disclosure.

FIG. 1A illustrates a block diagram of a display device according to an embodiment of the disclosure. Referring to FIG. 1A, the display device 100 includes a controlling circuit 110, a storage 120 and a display panel 130, where the controlling circuit 110 is coupled to the storage 120 and the display panel 130.

The controlling circuit 110 is configured to receive an externally input display content such as RGB data, execute instructions for carrying out the compensation method of the embodiments of the disclosure in order to output display data to a display driver of the display panel 130, such that the display driver may drive the display panel 130 to properly display images according to the display data output by the controlling circuit 110. In some embodiment, the controlling circuit 110 is implemented as including a time controller (TCON). In some embodiments, the controlling circuit 110 is implemented as including the time controller and further including a processor such as a central processing unit (CPU), other programmable general-purpose or specific-purpose microprocessors, a digital signal processor (DSP), a programmable controller, an application specific integrated circuit (ASIC), a programmable logic device (PLD), other similar devices, or a combination thereof, for example. It should be noted that the disclosure is not limited thereto.

Figure 1B:
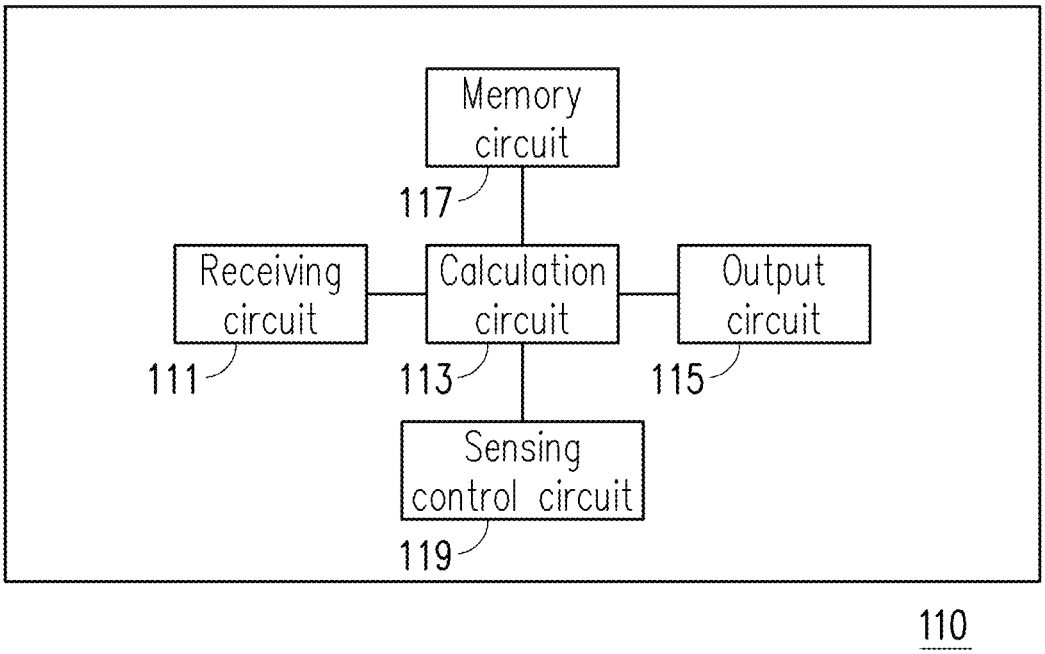
FIG. 1B illustrates a block diagram of a controlling circuit according to an embodiment of the disclosure.

FIG. 1B illustrates a block diagram of a controlling circuit according to an embodiment of the disclosure. Referring to FIG. 1B, in some embodiments, the controlling circuit 110 includes a receiving circuit 111, a calculation circuit 113, an output circuit 115, a memory circuit 117 and a sensing control circuit 119, wherein the receiving circuit 111, the output circuit 115, the memory circuit 117 and the sensing control circuit 119 are coupled to the calculation circuit 113. In some embodiment, the receiving circuit 111, the calculation circuit 113 and the memory circuit 117 are implemented in the processor of the controlling circuit 110, and the output circuit 115 and the sensing control circuit 119 are implemented in the time controller of the controlling circuit 110, but which is not limited herein. These circuits in the controlling circuit 110 cooperates to compensate the display device 100. Details of the compensation method will be introduced in the following descriptions.

The storage 120 is configured to store data needed for the compensation method of the embodiments of the disclosure. The storage 120 is, for example, any type of fixed or portable random access memory (RAM), read-only memory (ROM), non-volatile memory (NVM), or similar components, or a combination of the above components. It is noted that the disclosure in not limited thereto. In some embodiments, the storage 120 includes not only the NVM but also the RAM for accelerating the process speed.

The display panel 130 is configured to display images through a plurality of pixels thereof. The display panel 130 is, for example, an organic light emitting display (OLED) panel, an active matrix organic light emitting display (AMOLED) panel, or other types of panel in which the pixels may age with using time. It is noted that the disclosure is not limited thereto.

In some embodiments, the display panel 130 is an OLED panel in which each pixel is implemented as at least an OLED pixel circuit. The illuminance of each OLED pixel circuit is controlled by a current flowing through a thin-film transistor (TFT) and the current flowing through a TFT is in accordance with the following formula:

$$I_{TFT}=K(V_{gs}-V_{th})^2,$$

where $I_{TFT}$ is the current flowing through the TFT; K is a constant associated with the physical structure of the TFT; $V_{gs}$ is a bias difference between gate and source of the TFT; and $V_{th}$ is the threshold voltage of the TFT. It is noted that the threshold voltage $V_{th}$ may increase with the using time and the OLED pixel circuit is therefore being aged. In order to maintain the illuminance, the bias difference $V_{gs}$ applied to the TFT needs to be increased together with the threshold voltage $V_{th}$. That is to say, the processor 110 may compensate the aged pixel as long as the increment of the threshold voltage $V_{th}$ is known (e.g., by predicting or by sensing).

Figure 2:
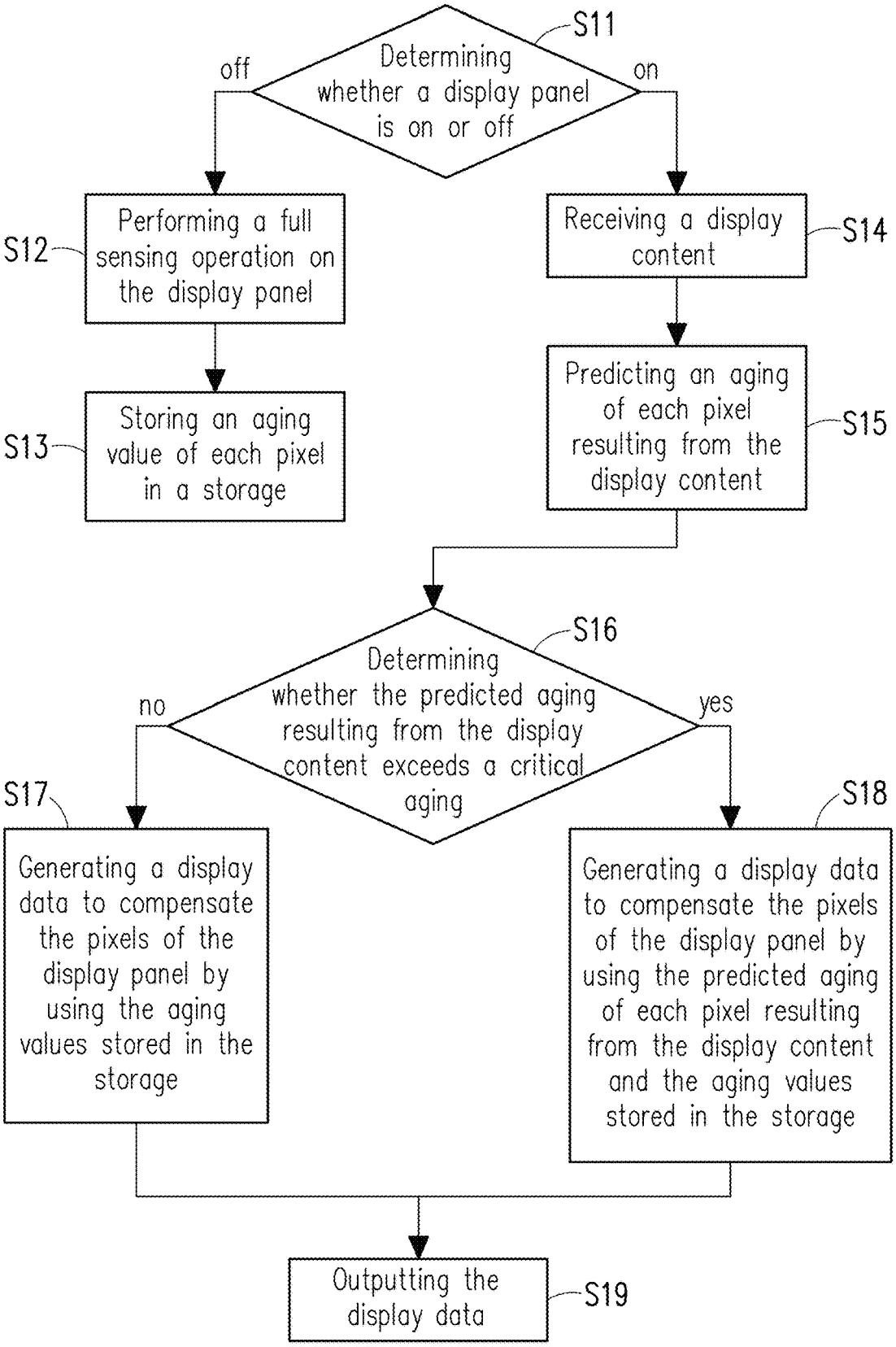
FIG. 2 illustrates a flowchart of a compensation method according to an embodiment of the disclosure.

FIG. 2 illustrates a flowchart of a compensation method according to an embodiment of the disclosure. Noted that the compensation method in embodiments of FIG. 2 is applicable to the display device 100 as illustrated in FIG. 1A and the controlling circuit 110 as illustrated in FIG. 1B, therefore it will be described accompanying with the elements of FIG. 1A and FIG. 1B in the following descriptions.

Referring to FIG. 2, in step S11, the controlling circuit 110 determines whether the display panel 130 is on or off. In some embodiments, the display device 100 is configured in a mobile electronic device such as a smart phone. As such, the display panel 130 may be turned on, for example, when a user wakes the mobile electronic device through a power button thereof or when the controlling circuit 110 wakes the display panel 130 in response to an incoming signal in order to notify the user of the incoming signal. On the other hands, the display panel 130 may be turned off, for example, when the user blacks the display panel 130 through the power button or when the mobile electronic device idles for a predetermined time. However, it should be noted that the disclosure is not limited thereto.

If the display panel 130 is off, the flow proceeds to step S12 for sensing the aging of each pixel of the display panel 130. In step S12, the controlling circuit 110 senses an aging of each pixel of the display panel 130 by performing a full sensing operation on the display panel 130, in order to obtain an aging value of each pixel. The aging value is, for example, a voltage increment $\Delta V_{th}$ of the threshold value $V_{th}$. In step S13, the controlling circuit 110 stores the aging value of each pixel into the storage 120.

In some embodiments, the sensing control circuit 119 of the controlling circuit 110 in the step S12 may control to sequentially charge the pixels of the display panel 130 and detect the threshold voltage $V_{th}$ of each pixel, so as to obtain the voltage increment $\Delta V_{th}$ of each pixel. Afterwards, the controlling circuit 110 in the step S13 may store the voltage increment $\Delta V_{th}$ of each pixel into the NVM of the storage 120 in form of, for example, a compensation table in which each entry is configured to record the voltage increment $\Delta V_{th}$ of each pixel of the display panel 130.

In some embodiments, the controlling circuit 110 stores the compensation table into the NVM of the storage 120 only when the full sensing operation is finished. If the controlling circuit 110 detects the display panel 130 is turned on during the full sensing operation, the full sensing operation fails and the step S13 is not entered. That is, no aging value sensed by the full sensing operation is stored into the NVM of the storage 120 if the full sensing operation fails.

If the display panel 130 is on, the flow proceeds to step S14 for receiving a display content. In some embodiments, the receiving circuit 111 of the controlling circuit 110 receives a display content from a device external to the display device 100. The display content includes, for example, a plurality of consecutive image frames to be sequentially displayed.

In step S15, the controlling circuit 110 predicts the aging of each pixel resulting from the display content in order to obtain an aging prediction. Specifically, pixels of the display panel 130 may be gradually aged while displaying the display content, and the controlling circuit 110 does not sense the aging of each pixel as in the step S12 but predicts the aging of each pixel resulting from the display content according to an aging model. The aging model indicates how the pixels of the display panel 130 decays when displaying, and it is associated with intrinsic characteristics of the pixels such as carrier mobility, threshold voltage, etc. In some embodiment, the aging model is established and stored into the NVM of the storage 120 when the display device 100 leaving the factory. As such, the aging of each pixel resulting from the display content, which is the aging prediction, can be calculated on the basis of the aging model.

In some embodiments, the aging model can be represented as:

$$\Delta V_{th_pre}=\beta(\text{display code}-\gamma)^{\alpha},$$

where the display code is a number positively related to the illuminance of an image frame of the display content, for example, an R, G or B color code of the image frame each in a range of [0, 255]; $\Delta V_{th_pre}$ is a predicted voltage increment of the threshold voltage $V_{th}$ resulting from the image frame; and $\alpha$, $\beta$ and $\gamma$ are constants associated with intrinsic characteristics of each pixel and are obtained according to historical or experimental data, for example.

Figure 3:
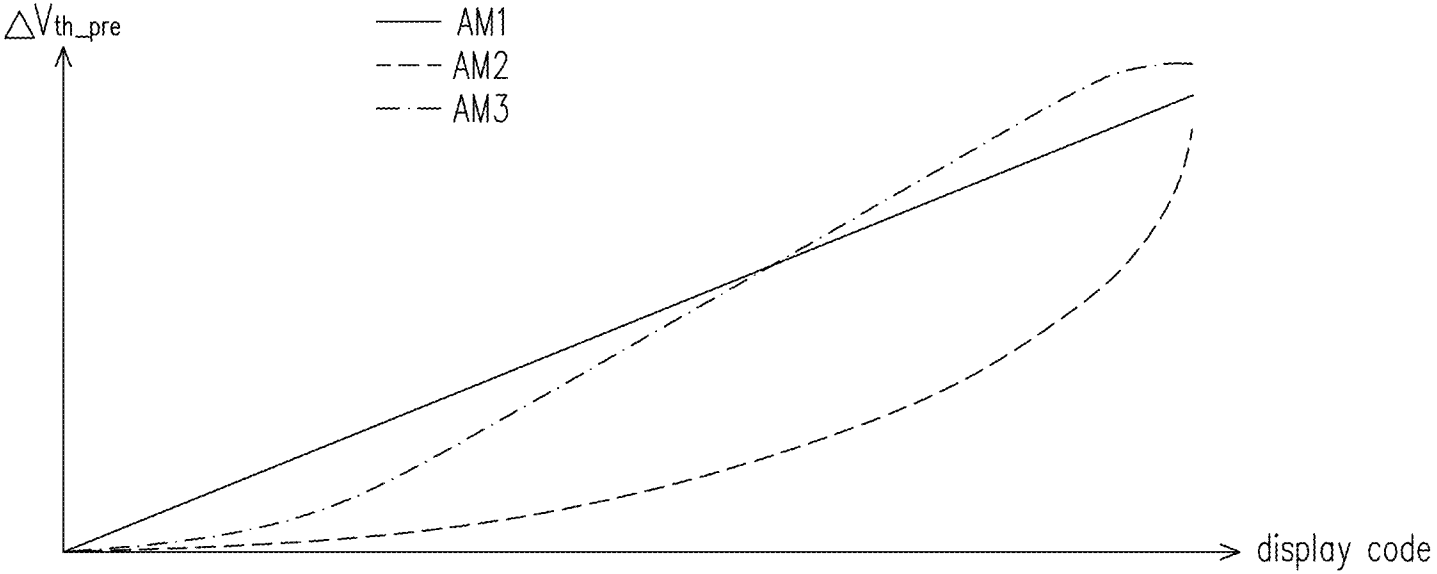
FIG. 3 illustrates a schematic diagram of an aging model according to an embodiment of the disclosure.

It is appreciated that the form of the aging model is not limited as above. In other embodiments, the aging model can be a linear distribution, an exponential distribution, or any other distributions. Referring to FIG. 3, according to the intrinsic characteristics of the pixels, the aging model can be linear as the aging model AM1, exponential as the aging model AM2, or arbitrary as the aging model AM3, for example. In some embodiments, the aging model may further be a function of time, which is not limited herein. It is appreciated that calculations using the aging model can be implemented by circuit logics, lookup tables, etc., which is not limited herein.

In some embodiments, by using such aging model, the aging prediction can be obtained by inputting data (e.g., the display code) of each image frame of the display content into the aging model for calculating the aging of each pixel resulting from each image frame and accumulating the aging of each pixel resulting from each image frame.

Figure 4A:
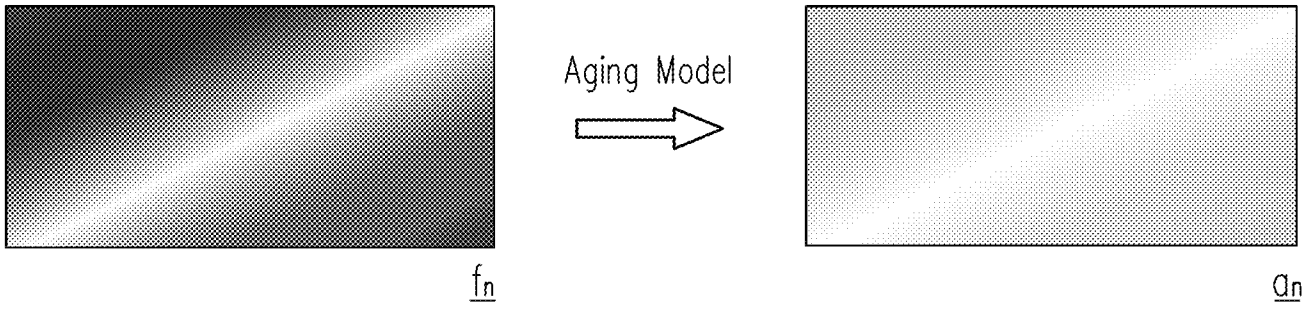
FIG. 4A and FIG. 4B illustrate schematic diagrams of predicting an aging of each pixel of the display panel resulting from the display content according to an embodiment of the disclosure.
Figure 4B:
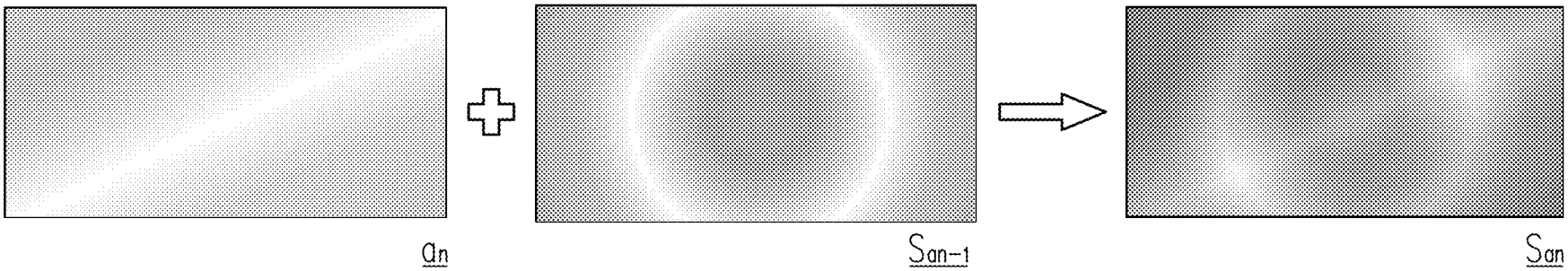

Specifically, when the receiving circuit 111 receives the $1^{st}$ image frame, the aging of each pixel resulting from the $1^{st}$ image frame of the display content (e.g., the aging prediction of the first image frame) may be calculated by the calculation circuit 113 by inputting data of the $1^{st}$ image frame into the aging model. The calculated aging resulting from the $1^{st}$ image frame is then stored (e.g., as an aging table) in the RAM of the storage 120 in some embodiments. When the receiving circuit 111 receives the $2^{nd}$ image frame, the accumulated aging of each pixel resulting from the first two image frames of the display content (e.g., the aging prediction of the first two image frames) may be calculated by the calculation circuit 113 by inputting data of the $2^{nd}$ image frame into the aging model to obtain the aging of each pixel resulting from the $2^{nd}$ image frame, and adding the aging resulting from the $2^{nd}$ image frame to the aging resulting from the $1^{st}$ image frame stored in the RAM of the storage 120. The accumulated aging of the $2^{nd}$ image frame is then stored in the RAM of the storage 120 (e.g., in the aging table) in some embodiments. When the receiving circuit 111 receives the $3^{rd}$ image frame, the accumulated aging of each pixel resulting from the first three image frames of the display content (e.g., the aging prediction of the first three image frames) may be calculated by the calculation circuit 113 by inputting data of the $3^{rd}$ image frame into the aging model to obtain the aging of each pixel resulting from the $3^{rd}$ image frame, and adding the aging resulting from the $3^{rd}$ image frame to the accumulated aging of the $2^{nd}$ image frame stored in the RAM of the storage 120. The accumulated aging of the $3^{rd}$ image frame is then stored in the RAM of the storage 120 (e.g., in the aging table) in some embodiments. Deduced by analogy, when the receiving circuit 111 receives a current image frame which is, for example, the $n^{th}$ image frame, the accumulated aging of each pixel resulting from the first n image frames of the display content (e.g., the aging prediction of the first n image frames) may be calculated by the calculation circuit 113 by inputting data of the $n^{th}$ image frame $f_n$ into the aging model to obtain the aging of each pixel resulting from the $n^{th}$ image frame $a_n$, and adding the aging of each pixel resulting from the $n^{th}$ image frame $a_n$ to the accumulated aging of the (n−1) image frames $S_{an-1}$ stored in the RAM of the storage 120 as shown in FIG. 4A and FIG. 4B, and the accumulated aging of the $n^{th}$ image frame $S_{an}$ is then stored in the RAM of the storage 120 (e.g., in the aging table) in some embodiments.

In some embodiments, for accelerating the calculation of the aging prediction, a lookup table including a mapping between a display code and an aging is pre-stored in the memory circuit 117 of the controlling circuit 110 (e.g., a cache of the processor of the controlling circuit). As such, the aging of each pixel resulting from the $n^{th}$ image frame can be calculated faster by consulting the lookup table in the memory circuit 117 according to data of the $n^{th}$ image frame, instead of inputting the data of the $n^{th}$ image frame into the aging model. The lookup table may be, for example, established according to the aging model, stored in the NVM of the storage 120 (e.g., when the display device 110 leaves the factory), and loaded into the memory circuit 117 before the step 15. However, the disclosure is not limited thereto.

It is noted that the grey scales illustrated in the figures are corresponding to the illuminance or the increment of the threshold voltage. Referring to FIG. 4A and FIG. 4B, the predicted increment of the threshold voltage $a_n$ is calculated by inputting the $n^{th}$ image frame $f_n$ into the aging model or by consulting the lookup table which is establish based on the aging model according to the $n^{th}$ image frame $f_n$, and an accumulated aging of the $n^{th}$ image frame $Sa_n$ (e.g., the aging prediction of the first n image frames) is calculated by adding the predicted increment of the threshold voltage $a_n$ to the accumulated aging of the $(n-1)^{th}$ image frame $Sa_{n-1}$ stored in the RAM of the storage 120.

In step S16, the controlling circuit 110 determines whether the predicted aging resulting from the display content exceeds a critical aging. Specifically, if the predicted aging resulting from the display content is too obvious to be ignored by the user, the display panel 130 needs to be compensated by using not only the aging value of each pixel obtained when the display panel 130 is off and stored in the NVM of the storage 120 but also the predicted aging resulting from the display content. Otherwise, the aging values stored in the NVM of the storage 120 is enough for compensating the display panel 130. As such, the calculation circuit 113 of the controlling circuit 110 determines whether the predicted aging resulting from the display content exceeds the critical aging in the step S16.

In some embodiments, the calculation circuit 113 sets an aging threshold as the critical aging and compares the predicted aging resulting from the display content with the aging threshold. If there is any pixel of which the predicted aging resulting from the display content is higher than the aging threshold, which means that the predicted aging resulting from the display content is too obvious to be ignored by the user, then the calculation circuit 113 determines that the predicted aging resulting from the display content exceeds the critical aging and the flow proceeds to step S18. Otherwise, the calculation circuit 113 determines that the predicted aging resulting from the display content does not exceed the critical aging and the flow proceeds to step S17.

In the step S18, the controlling circuit 110 generates a display data to compensate the pixels of the display panel 130 by using the predicted aging of each pixel resulting from the display content and the aging values stored in the storage 120. In the step S19, the controlling circuit 110 outputs the display data. In some embodiments, as shown in FIG. 5, the aging table stores the accumulated aging $Sa_n$ of each pixel resulting from the current image frame $f_n$, and the compensation table stores the voltage increment $\Delta V_{th}$ of each pixel before the display panel is on. The calculation circuit 113 of the controlling circuit 110 may generate a display data that makes a display driver of the display panel 130 to drive the display panel 130 to display the current image frame or a next image frame while raising the bias difference between gate and source of each pixel by an addition of the accumulated aging $Sa_n$ and the voltage increment $\Delta V_{th}$ of each pixel, so as to compensate the display panel 130. Afterwards, the output circuit 115 of the controlling circuit 110 may output the display data, for example, to the display driver of the display panel 130 such that the display panel 130 can be compensated when displaying the current image frame or the next image frame according to the display data.

In the step S17, the controlling circuit 110 generates a display data to compensate the pixels of the display panel 130 by using the aging values stored in the storage 120. In the step S19, the controlling circuit 110 outputs the display data. In some embodiments, the compensation table stores the voltage increment $\Delta V_{th}$ of each pixel, therefore the calculation circuit 113 of the controlling circuit 110 may generate a display data that makes a display driver of the display panel 130 to drive the display panel 130 to display the current image frame while raising the bias difference between gate and source of each pixel by the voltage increment $\Delta V_{th}$ of each pixel, so as to compensate the display panel 130. Afterwards, the output circuit 115 of the controlling circuit 110 may output the display data, for example, to the display driver of the display panel 130 such that the display panel 130 can be compensated when displaying the current image frame according to the display data.

In some embodiments, the processor of the controlling circuit 110 loads the compensation table stored in the NVM of the storage 120 into the RAM of the storage 120 after determining that the display panel 130 is on in the step S11 and before the flow proceeds to the step S17 or the step S18, such that data of the compensation table can be quickly used in the step S17 or the step S18.

It is noted that the compensation method illustrated in embodiments of FIG. 2 allows the aging resulting from the display content be compensated timely during the display panel 130 displaying images corresponding to the display content. Therefore, a critical aging occurred during the user using the display panel 130 is timely compensated. As such, the user is not supposed to perceive the aging on the display panel 130 when adopting the introduced compensation method.

Figure 6:
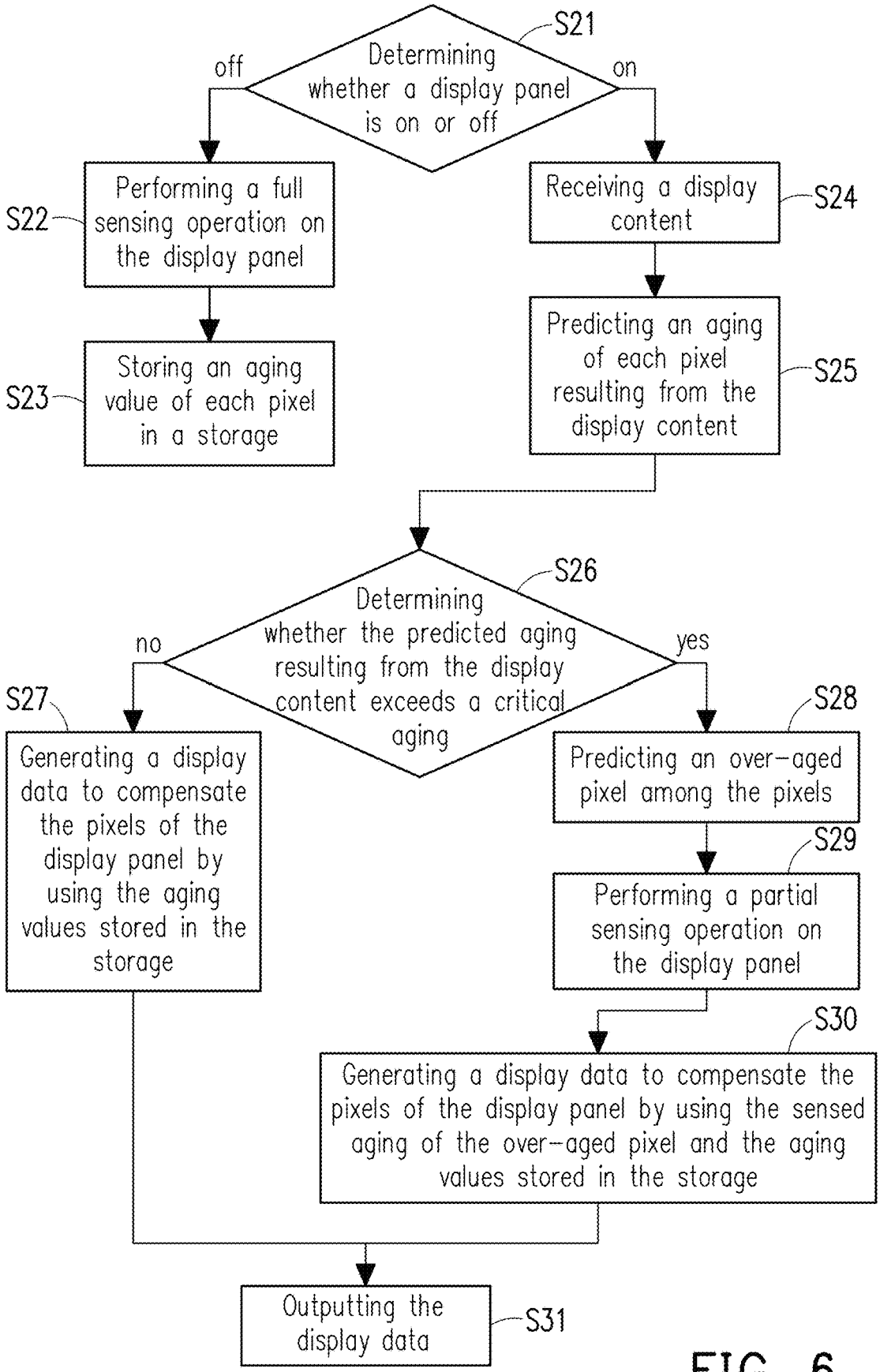
FIG. 6 illustrates a flowchart of a compensation method according to an embodiment of the disclosure.

FIG. 6 illustrates a flowchart of a compensation method according to another embodiment of the disclosure. Noted that the compensation method in embodiments of FIG. 6 is applicable to the display device 100 as illustrated in FIG. 1A and the controlling circuit 110 as illustrated in FIG. 1B, therefore it will be described accompanying with the elements of FIG. 1A and FIG. 1B in the following descriptions. Also noted that steps S21 to S27 are similar to the step S11 to S17 described in the embodiments of FIG. 2, therefore details of steps S21 to S27 are not repeated herein. Instead of generating the display data for compensating the pixels on the basis of a predicted aging, the controlling circuit 110 senses the aging of the pixels that have a predicted aging exceeds the critical aging and generates the display data for compensating the pixels on the basis of the actually sensed aging in the embodiments of FIG. 6. As such, more accurate compensation can be performed.

Referring to FIG. 6, the flow proceeds to step S28 after it is determined in step S26 by the calculation circuit 113 that the predicted aging of at least one pixel resulting from the display content exceeds the critical aging. The calculation circuit 113 predicts an over-aged pixel among the pixels in the step S28, and the sensing control circuit 119 senses the aging of the over-aged pixel by performing a partial sensing operation on the display panel in step S29. Specifically, the over-aged pixel is a pixel of which the predicted aging resulting from the display content exceeds the critical aging or the predicted voltage increment $\Delta V_{th_pre}$ exceeds the aging threshold set by the calculation circuit 113. For shortening the sensing time, the sensing control circuit 119 only senses the aging of part of the pixels including the over-aged pixels instead of sensing all pixels of the display panel 130.

Figure 8:
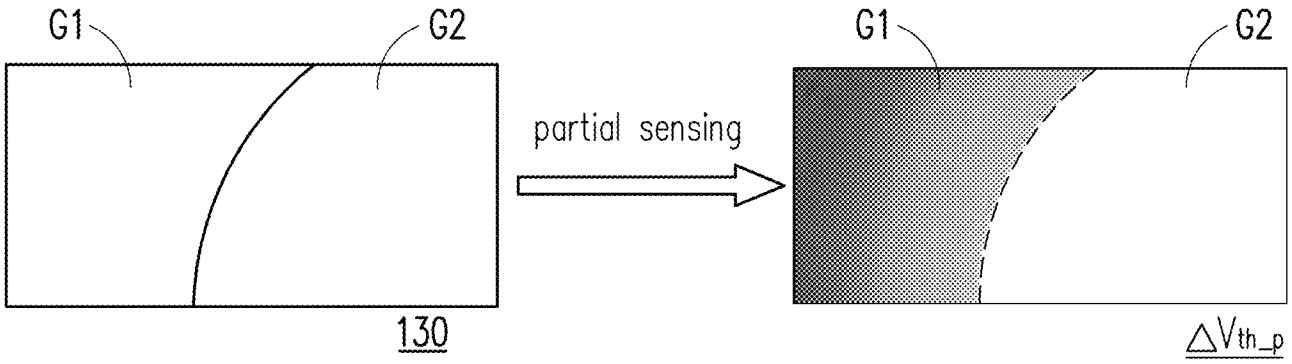
FIG. 8 illustrates a schematic diagram of sensing the aging of the over-aged pixel by performing the partial sensing operation on the display panel according to an embodiment of the disclosure.

In some embodiments, there are multiple over-aged pixels on the display panel 130, the sensing control circuit 119 performs the partial sensing operation on the display panel 130 for sensing the aging of the over-aged pixels. For instance, as shown in FIG. 8, all pixels of the display panel 130 may be divided into two groups, i.e., the first group G1 and the second group G2, where the first group G1 includes all of the over-aged pixels and the second group G2 does not include any over-aged pixel. The sensing control circuit 119 then senses the aging of the pixels in the first group G1, in order to obtain a partial sensing result $\Delta V_{th_p}$ which indicates the aging (e.g., increment of the threshold voltage) of each pixel in the first group G1.

It is noted that the partial sensing operation senses fewer pixels than (or same pixels as) the full sensing operation, therefore the operation time of the partial sensing operation is not longer than the operation time of the full sensing operation. It is also noted that since the partial sensing operation is performed during a display time of the display content and should not be noticed by the user, it needs to shorten the sensing time for sensing each pixel and its accuracy is sacrificed in some cases. Therefore, the accuracy of the full sensing operation is higher than the accuracy of the partial sensing operation in some embodiments.

Figure 7A:
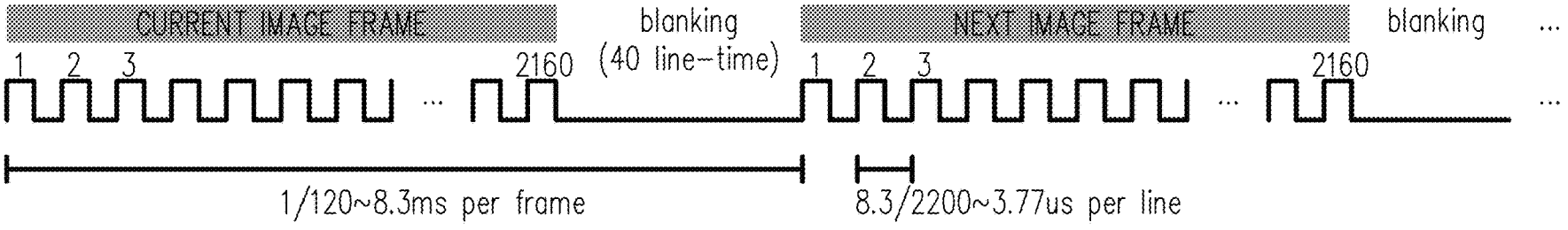
FIG. 7A, FIG. 7B and FIG. 7C illustrate schematic diagrams of a partial sensing operation according to an embodiment of the disclosure.
Figure 7B:
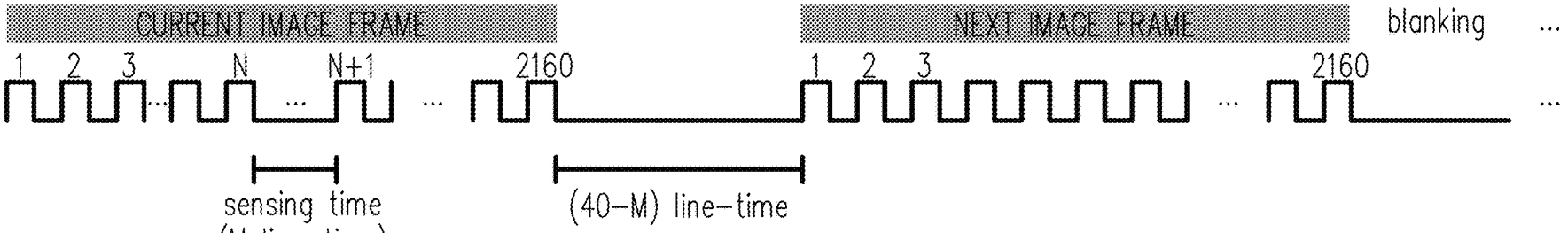
Figure 7C:
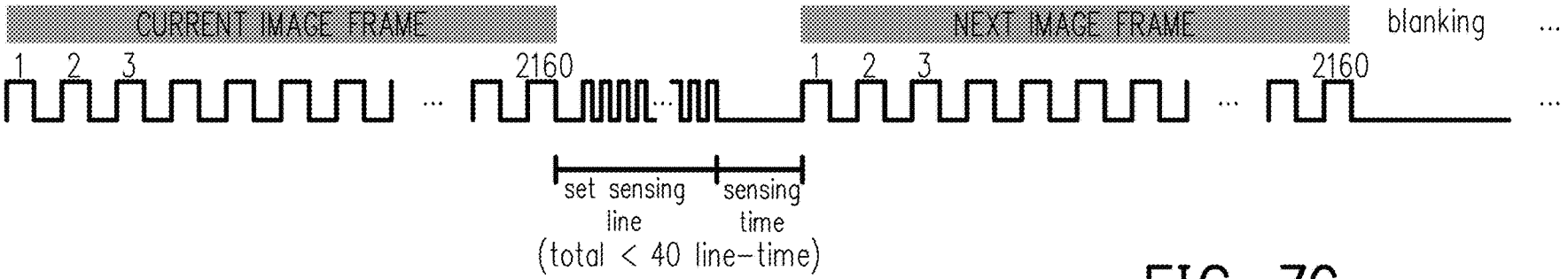

FIG. 7A, FIG. 7B and FIG. 7C illustrate schematic diagrams of a partial sensing operation according to an embodiment of the disclosure. For illustrating the partial sensing operation, as shown in FIG. 7A, it is assumed that the size of the display panel 130 is 3840 pixels*2160 lines, the frame rate is 120 Hz, and a blanking time between each two of the consecutive image frames of the display content is 40 line-time. As such, when displaying images corresponding to the display content, it takes about 8.3 ms (i.e., 1 s/120) per image frame, and the line-time is about 3.77 μs (i.e., 8.3 ms/(2160+40)) per line. For not being noticed by the user, the partial sensing operation has to be finished in a time shorter than the blanking time (i.e., 40*3.77 μs).

In some embodiments, the partial sensing operation can be an in-display sensing operation which is performed in the frame time of the current image frame as shown in FIG. 7B. Specifically, when an over-aged pixel is on the $N^{th}$ line, the sensing control circuit 119 may sense the aging of the over-aged pixel on the $N^{th}$ line after updating data of the $N^{th}$ line and before updating data of the $(N+1)^{th}$ line. The operation time (e.g., M line-time) for sensing the over-aged pixel on the $N^{th}$ line is not longer than the original blanking time (e.g., 40 line-time), therefore some time (e.g., (40-M) line-time) between the current image frame and a next image frame can be reserved. As such, the partial sensing operation can be completed and the partial sensing result can be obtained before displaying the next image frame, without being noticed by the user.

In some embodiments, the partial sensing operation can be an in-blanking sensing operation which is performed in the blanking time between the current image frame and the next current frame as shown in FIG. 7C. Specifically, the in-blanking sensing operation is performed after the current image framed is displayed and before the next image frame starts being displayed. When an over-aged pixel is on the $N^{th}$ line, the sensing control circuit 119 locates and sets the line to be sensed (i.e., the $N^{th}$ line) before starting to sense the over-aged pixel on the $N^{th}$ line. Comparing to the aforementioned in-display sensing operation, the in-blanking sensing operation needs an additional time for locating and setting the $N^{th}$ line. For not being noticed by the user, the total time of said additional time for locating and setting the $N^{th}$ line and the sensing time (e.g., M line-time) for sensing the over-aged pixel on the $N^{th}$ line is not longer than the original blanking time (e.g., 40 line-time). As such, the partial sensing operation can be completed and the partial sensing result can be obtained before displaying the next image frame, without being noticed by the user.

Figure 9:
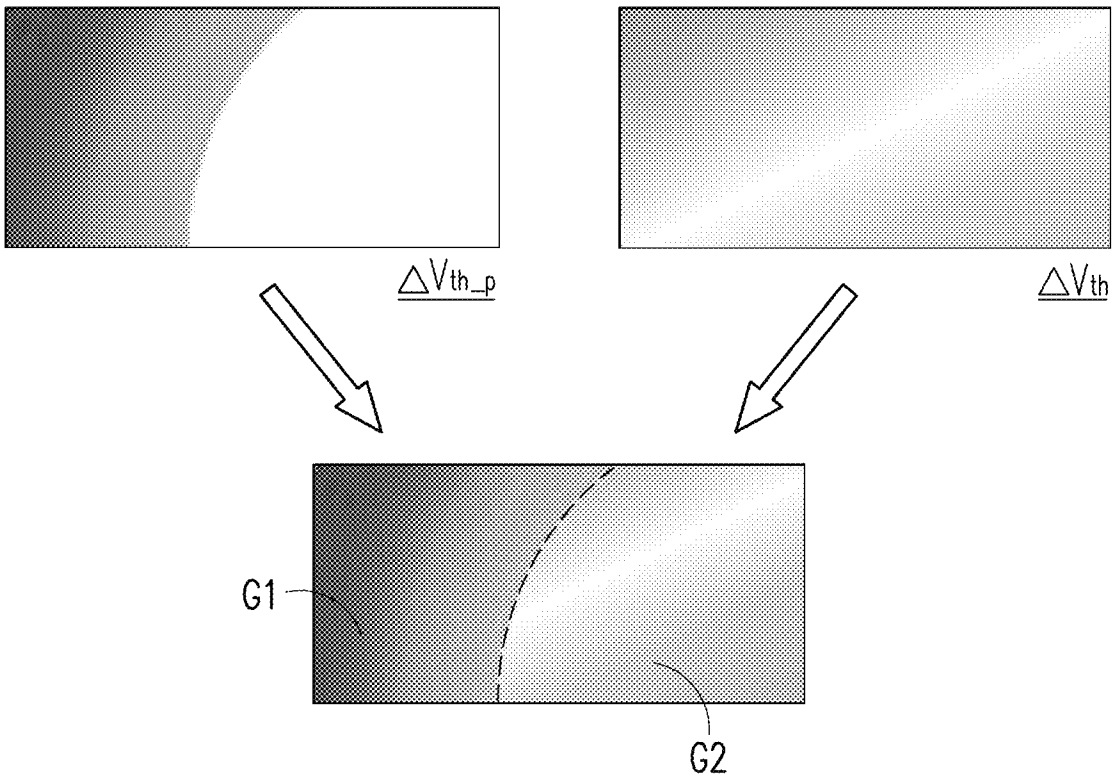
FIG. 9 illustrates a schematic diagram of compensating the display panel by using the sensed aging of the over-aged pixel and the compensation value stored in the storage according to an embodiment of the disclosure.

After the partial sensing result is obtained, in step S30, the calculation circuit 113 of the controlling circuit 110 may generate a display data to compensate the pixels of the display panel by using the sensed aging of the over-aged pixel and the aging values stored in the storage. In the step S31, the output circuit 115 of the controlling circuit 110 outputs the display data. In some embodiments, the pixels of the display panel 130 are divided into the first group G1 and the second group G2, and the partial sensing result $\Delta V_{th_p}$ indicating the aging (e.g., increment of the threshold voltage) of each pixel in the first group G1 is obtained. The calculation circuit 113 then generate a display data for driving the display panel 130 to display images corresponding to the display content. As shown in FIG. 9, the display data is generated for compensating the pixels in the first group G1 by using the partial sensing result $\Delta V_{th_p}$ and compensating the pixels in the second group G2 by using the aging values stored in the NVM of the storage 120 (e.g., the compensation table stores the voltage increment $\Delta V_{th}$ of each pixel). Afterwards, the output circuit 115 of the controlling circuit 110 may output the display data, for example, to the display driver of the display panel 130 such that the display panel 130 can be compensated when displaying images according to the display data.

Referring to FIG. 9, for the first group G1, the calculation circuit 113 may generate the display data that makes a display driver of the display panel 130 to drive the pixels in the first group G1 to display the next image frame by raising the bias difference between gate and source of each pixel in the first group G1 by the partial sensing result $\Delta V_{th_p}$. On the other hand, for the second group G2, the display data makes the display driver of the display panel 130 to drive the pixels in the second group G2 to display the next image frame by raising the bias difference between gate and source of each pixel in the second group G2 by the voltage increment $\Delta V_{th}$ of each pixel in the second group G2. Afterwards, the output circuit 115 of the controlling circuit 110 may output the display data, for example, to the display driver of the display panel 130 such that all pixels of the display panel 130 can be compensated when displaying the next image frame according to the display data.

It is noted that the compensation method illustrated in embodiments of FIG. 6 performs a fast sensing on the pixels that are predicted to be over-aged without being noticed by the user, which therefore allows the aging resulting from the display content be compensated timely and accurately during the display panel 130 displaying images corresponding to the display content. Therefore, a critical aging occurred during the user using the display panel 130 is timely and accurately compensated. As such, the user is not supposed to perceive the aging on the display panel 130 when adopting the introduced compensation method as well.

In summary, the compensation method for pixel aging and the controlling circuit for compensating the display device in embodiments of the disclosure predict an aging resulting from a display content, and compensate pixels of the display panel according to the predicted aging. As such, compensation for the aging resulting from the display content can be completed during the display time of the display content, thus the display quality can be maintained. In some embodiments, an actual aging of pixels predicted to be over-aged due to the current image frame is rapidly sensed by using a partial sensing operation before displaying the next image frame. As such, the pixels of the display panel can be timely and accurately compensated without being noticed by the user when displaying images corresponding to the display content.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A compensation method for pixel aging, applicable to a controlling circuit of a display device having a display panel, comprising:

receiving a display content by the controlling circuit;

predicting, by the controlling circuit, an aging of each of a plurality of pixels of the display panel resulting from the display content in order to obtain an aging prediction;

generating, by the controlling circuit, a display data to compensate the display panel according to the aging prediction, wherein generating the display data comprises:

determining, according to the aging prediction, whether the predicted aging resulting from the display content exceeds a critical aging by the controlling circuit; and generating, by the controlling circuit, the display data to compensate the display panel by using an aging value stored in a storage when it is determined that the predicted aging resulting from the display content does not exceed the critical aging; and outputting the display data by the controlling circuit.

2. The compensation method as claimed in claim 1, wherein the display content comprises a plurality of consecutive image frames, and predicting, by the controlling circuit, the aging of each pixel of the display panel resulting from the display content in order to obtain the aging prediction comprises:

calculating, by the controlling circuit, the aging of each pixel resulting from a current image frame of the image frames according to an aging model which is associated with intrinsic characteristics of the pixels; and obtaining, by the controlling circuit, the aging prediction by adding the aging resulting from the current image frame to an accumulated aging of the image frames previous to the current image frame.

3. The compensation method as claimed in claim 2, wherein the display content is received when the display panel is on, and the compensation method further comprises:

sensing, by the controlling circuit, the aging of each pixel of the display panel by performing a full sensing operation on the display panel when the display panel is off, in order to obtain the aging value of each pixel; and storing the aging value of each pixel in the storage of the display device.

4. The compensation method as claimed in claim 1, wherein generating, by the controlling circuit, the display data to compensate the display panel according to the aging prediction further comprises:

generating, by the controlling circuit, the display data to compensate the display panel by using the predicted aging resulting from the display content and the aging value stored in the storage when it is determined that the predicted aging resulting from the display content exceeds the critical aging.

5. The compensation method as claimed in claim 1, wherein when it is determined that the predicted aging resulting from the display content exceeds the critical aging, outputting, by the controlling circuit, the display data while compensating the display panel based on the aging prediction further comprises:

predicting, by the controlling circuit, an over-aged pixel among the pixels according to the aging prediction;

sensing, by the controlling circuit, the aging of the over-aged pixel resulting from the display content by performing a partial sensing operation on the display panel; and generating, by the controlling circuit, the display data to compensate the display panel by using the sensed aging of the over-aged pixel and the aging value stored in the storage.

6. The compensation method as claimed in claim 5, wherein an operation time of the partial sensing operation is not longer than a blanking time between two of the consecutive image frames.

7. The compensation method as claimed in claim 5, wherein an accuracy of the full sensing operation is higher than an accuracy of the partial sensing operation.

8. The compensation method as claimed in claim 5, wherein sensing, by the controlling circuit, the aging of the over-aged pixel resulting from the display content by performing the partial sensing operation on the display panel comprises:

performing, by the controlling circuit, the partial sensing operation to obtain a partial sensing result by sensing the aging of the pixels in a first group and not sensing the pixels in a second group, wherein the pixels of the display panel are divided into the first group and the second group, wherein the first group comprises the over-aged pixel and the second group does not comprise the over-aged pixel.

9. The compensation method as claimed in claim 8, wherein generating, by the controlling circuit, the display data to compensate the display panel by using the sensed aging of the over-aged pixel and the aging value stored in the storage comprises:

generating, by the controlling circuit, the display data to compensate the pixels in the first group by using the partial sensing result; and generating, by the controlling circuit, the display data to compensate the pixels in the second group by using the aging value stored in the storage.

10. A controlling circuit for compensating a display device, comprising:

a receiving circuit, configured to receive a display content;

a calculation circuit, coupled to the receiving circuit and configured to predict an aging of each of a plurality of pixels of a display panel of the display device resulting from the display content in order to obtain an aging prediction, generate a display data to compensate the display panel according to the aging prediction, and determine, according to the aging prediction, whether the predicted aging resulting from the display content exceeds a critical aging, wherein when generating the display data, the calculation circuit is configured to:

generate the display data to compensate the display panel by using an aging value stored in a storage when it is determined by the calculation circuit that the predicted aging resulting from the display content does not exceed the critical aging; and an output circuit, coupled to the calculation circuit and configured to output the display data.

11. The controlling circuit as claimed in claim 10, wherein the display content comprises a plurality of consecutive image frames, and when predicting the aging of each pixel of the display panel resulting from the display content in order to obtain the aging prediction, the calculation circuit is configured to:

calculate the aging of each pixel resulting from a current image frame of the image frames according to an aging model which is associated with intrinsic characteristics of the pixels; and obtain the aging prediction by adding the aging resulting from the current image frame to an accumulated aging of the image frames previous to the current image frame.

12. The controlling circuit as claimed in claim 11, wherein the display content is received when the display panel is on, and the controlling circuit further comprises:

a sensing control circuit, coupled to the calculation circuit and configured to:

sense the aging of each pixel of the display panel by performing a full sensing operation on the display panel when the display panel is off, in order to obtain the aging value of each pixel; and store the aging value of each pixel into the storage of the display device.

13. The controlling circuit as claimed in claim 10, wherein when generating the display data to compensate the display panel according to the aging prediction, the calculation circuit is further configured to:

generate the display data to compensate the display panel by using the predicted aging resulting from the display content and the aging value stored in the storage when it is determined by the calculation circuit that the predicted aging resulting from the display content exceeds the critical aging.

14. The controlling circuit as claimed in claim 10, wherein when it is determined by the calculation circuit that the predicted aging resulting from the display content exceeds the critical aging, the calculation circuit is further configured to predict an over-aged pixel among the pixels according to the aging prediction, the sensing control circuit is further configured to sense the aging of the over-aged pixel resulting from the display content by performing a partial sensing operation on the display panel and the calculation circuit is further configured to generate the display data to compensate the display panel by using the sensed aging of the over-aged pixel and the aging value stored in the storage.

15. The controlling circuit as claimed in claim 14, wherein an operation time of the partial sensing operation is not longer than a blanking time between two of the consecutive image frames.

16. The controlling circuit as claimed in claim 14, wherein an accuracy of the full sensing operation is higher than an accuracy of the partial sensing operation.

17. The controlling circuit as claimed in claim 14, wherein when sensing the aging of the over-aged pixel resulting from the display content by performing the partial sensing operation on the display panel, the sensing control circuit is configured to:

perform the partial sensing operation to obtain a partial sensing result by sensing the aging of the pixels in a first group and not sensing the pixels in a second group, wherein the pixels of the display panel are divided into the first group and the second group, wherein the first group comprises the over-aged pixel and the second group does not comprise the over-aged pixel.

18. The controlling circuit as claimed in claim 17, wherein when generating the display data to compensate the display content by using the sensed aging of the over-aged pixel and the aging value stored in the storage, the calculation circuit is configured to:

generate the display data to compensate the pixels in the first group by using the partial sensing result; and generate the display data to compensate the pixels in the second group by using the aging value stored in the storage.

* * * * *